US007717302B2

(12) United States Patent
Crosnier et al.

(10) Patent No.: US 7,717,302 B2
(45) Date of Patent: May 18, 2010

(54) PUMP AND A RECEPTACLE FITTED THEREWITH

(75) Inventors: Daniel Crosnier, Offranville (FR); Vanessa Brinkmeyer, Paris (FR)

(73) Assignee: L'Oreal, Paris (FR)

( * ) Notice: Subject to any disclaimer, the term of this patent is extended or adjusted under 35 U.S.C. 154(b) by 169 days.

(21) Appl. No.: 10/733,256

(22) Filed: Dec. 12, 2003

(65) Prior Publication Data

US 2004/0159681 A1 Aug. 19, 2004

Related U.S. Application Data

(60) Provisional application No. 60/438,324, filed on Jan. 7, 2003.

(30) Foreign Application Priority Data

Dec. 16, 2002 (FR) ..... 02 15911

(51) Int. Cl.
*B65B 88/54* (2006.01)

(52) U.S. Cl. ..... 222/321.2; 222/321.9; 222/321.7

(58) Field of Classification Search ..... 222/321.2, 222/321.4, 321.7, 321.9, 340, 383.1
See application file for complete search history.

(56) References Cited

U.S. PATENT DOCUMENTS 4,277,001 A * 7/1981 Nozawa ..... 222/321.4
4,823,991 A 4/1989 Skorka
5,358,149 A * 10/1994 O'Neill ..... 222/321.2
5,458,289 A * 10/1995 Cater ..... 239/119
5,775,548 A 7/1998 Hohmann et al.
5,992,704 A 11/1999 Jäger-Waldau
6,220,483 B1 * 4/2001 van der Heijden ..... 222/136
6,308,867 B1 10/2001 Wolter
6,811,060 B2 * 11/2004 Petit ..... 222/321.2
2002/0043540 A1 4/2002 Baudin

FOREIGN PATENT DOCUMENTS

NL 8420310 11/1985

* cited by examiner

*Primary Examiner*—Frederick C. Nicolas
(74) *Attorney, Agent, or Firm*—Oliff & Berridge, PLC

(57) ABSTRACT

The present invention provides a pump (1; 60; 90) for mounting on a receptacle (3), the pump including:

an air intake passage formed between the pump body and the moving assembly and capable of communicating with the opening (18) of the pump body;

a first lip (40) arranged, after the moving assembly has moved away from a rest position in the substance-dispensing direction, to press in leaktight manner against the pump body and prevent communication between the inside of the receptacle and the pump chamber (6) via the opening (18); and a second lip situated above the first lip when the pump is observed in the head-up position, said second lip being arranged to close the air intake passage when the moving assembly is in its rest position and to release said passage when the moving assembly (5) is displaced in the substance-dispensing direction.

31 Claims, 5 Drawing Sheets

PUMP AND A RECEPTACLE FITTED THEREWITH

CROSS-REFERENCE TO RELATED APPLICATION

This application claims the benefit of U.S. Provisional Application No. 60/438,324 filed on Jan. 7, 2003, the disclosure of which is incorporated by reference herein.

BACKGROUND OF THE INVENTION

1. Field of Invention

The present invention relates in particular to a pump for mounting on a receptacle, and serving to dispense a substance in a head-up or a head-down position.

2. Description of Related Art

French Patent Application No. FR 2 528 122 discloses a pump enabling a substance to be dispensed in a head-up or a head-down position, and comprising a pump body with a moving assembly in the pump body and co-operating therewith to define a pump chamber of variable volume.

The pump body has a lateral opening enabling the substance contained in the receptacle to penetrate into the pump chamber when the pump is used head-down. The moving assembly has a lip enabling the above-mentioned opening in the pump chamber to be isolated after it has been moved a certain distance into the pump body.

Such a pump has two helical springs which are in contact with the substance, and that can lead to problems of compatibility between the substance and the metal of the springs.

In addition, that pump has a relatively large number of parts, which is reflected in its manufacturing cost.

Finally, if the pump is held head-down for a long period, it can happen that the substance will leak out, particularly if the substance is not very viscous.

SUMMARY OF THE INVENTION

There exists a need for a pump which remedies those drawbacks in full or in part, and in particular which is relatively simple in structure while enabling a substance to be dispensed in satisfactory manner, even when the substance is not very viscous.

In an exemplary embodiment, the invention provides a pump for mounting on a receptacle, the pump comprising:

a pump body; and a moving assembly that is movable relative to the pump body and that co-operates therewith to define a pump chamber of variable volume, the pump chamber being suitable for communicating with the inside of the receptacle via at least one opening of the pump body disposed in such a manner as to enable the pump to operate in a head-down position, the pump further comprises:

an air intake passage formed between the pump body and the moving assembly and capable of communicating with the opening of the pump body;

a first lip arranged, after the moving assembly has moved away from a rest position in the substance-dispensing direction, to press in leaktight manner against the pump body and prevent communication between the inside of the receptacle and the pump chamber via the opening; and a second lip situated above the first lip when the pump is in the head-up position, wherein the second lip is arranged to close the air intake passage when the moving assembly is in its rest position, and to release the air intake passage when the moving assembly is displaced in the substance-dispensing direction.

In various exemplary embodiments, the invention is usable in particular to reduce the risk of substance leaking out in the event of the pump being held head-down at rest.

Since the moving assembly includes a dispenser orifice, the orifice can be situated, for example, on the side opposite from the opening if there is only one opening, thereby avoiding the pump chamber from emptying when the pump is used in a substantially horizontal position with the dispenser orifice facing downward.

Advantageously, each of the first and second lips presents a shape that is substantially frustoconical, flaring toward the pump chamber.

In an exemplary embodiment of the invention, the moving assembly includes a third lip disposed in such a manner as to be pressed against the pump body to close the air intake passage when the moving assembly is at the end of its substance-dispensing stroke, thus making it possible when the pump is used head-down to avoid substance leaking out even if the moving assembly is maintained for an extended period in its end-of-stroke position.

In an exemplary embodiment of the invention, the pump body and the second lip may be arranged in such as manner as to close the air intake passage when the moving assembly is at the end of its stroke, in which case the moving assembly need not have a third lip. In this exemplary embodiment, the pump body may include, for example, at least one setback, in particular a channel extending parallel to the axis along which the moving assembly moves, said setback being situated between two regions against which the second lip presses when the moving assembly repetitively occupies its rest position and its end-of-stroke position. The setback provides communication between the regions when the moving assembly occupies a position that is intermediate between its rest position and its end-of-stroke position.

In an exemplary embodiment of the invention, the moving assembly comprises a pushbutton and an insert fitted thereto, the pushbutton and the insert being arranged together to define a passage for delivering the substance, at least when the pump is actuated to dispense the substance.

The first, second, and third above-mentioned lips may be made on the insert.

In an exemplary embodiment of the invention, the pushbutton comprises two portions, one of which is stationary relative to the insert and the other is movable relative thereto, the insert and the movable portion of the pushbutton may include respective surfaces for co-operating to close the passage for delivering the substance when the moving assembly is in its rest position and for opening the passage when the movable portion is moved through a determined distance relative to the stationary portion.

In the exemplary embodiment described, the pushbutton is arranged so that the movable portion can move through the above-mentioned determined distance relative to the insert from its rest position only when the force exerted on the pushbutton exceeds a threshold. This enables the passage for delivering the substance to be disengaged only once the substance has been compressed in the pump chamber.

The stationary portion and the movable portion of the pushbutton may be connected to each other by a web of elastically-deformable material, the web possibly presenting an annular shape.

In an exemplary embodiment of the invention, the pump includes a resilient return element suitable for returning the moving assembly into its rest position. The resilient return element may be placed outside the pump chamber and comprise, for example, a helical spring working in compression. Advantageously, the resilient return element is made integrally with the pushbutton.

In an exemplary embodiment of the invention, the pump body is arranged to enable a dip tube to be fastened thereto, and the pump may include a check valve that closes while the volume of the pump chamber is decreasing and that opens while the volume of the pump chamber is increasing. This check valve can be disposed in such a manner to enable the pump chamber to be fed with substance via the dip tube when the pump is used head-up.

Advantageously, the volume of the pump chamber in the rest position is greater than the volume of a quantity or "dose" of substance to be dispensed, thereby reducing the risk of the pump becoming unprimed.

In an exemplary embodiment of the invention, the pushbutton is stationary relative to the insert with the insert possibly including a skirt suitable for co-operating in leaktight manner with a spike of the pump body while the pump is at rest in order to isolate the pump chamber from the outside.

The insert may include a check valve suitable for closing an upper opening of the skirt while the volume of the pump chamber is increasing and suitable for allowing substance to pass through while the volume of the pump chamber is decreasing.

The check valve may comprise a valve member that is connected to the skirt by a web of frangible material, prior to first use of the pump. The valve member may come into abutment against the spike when the pushbutton is depressed in order to rupture the web of frangible material.

Independently or in combination with the above, the invention also provides, in an exemplary embodiment, a pump for mounting on a receptacle, the pump comprising:

a pump body, the pump body including a spike; and a moving assembly including a pushbutton and arranged to co-operate with the pump body to define a pump chamber of variable volume, the moving assembly including a skirt via which substance present in the chamber can be delivered toward a dispensing orifice, the skirt being capable of co-operating with the spike when the pump is at rest in order to isolate the inside of the skirt from the pump chamber.

By way of example, the skirt may be provided with a valve member which, prior to first use of the pump, is connected to the skirt by a web of frangible material. When the moving assembly is moved downwards on first use of the pump, the valve member comes into abutment against the spike and is moved inside the skirt until it reaches a position where the valve member co-operates with an upper opening of the skirt to form a check valve. In operation of the pump, the check valve opens while the volume of the pump chamber is decreasing and closes while the volume of the pump chamber is increasing, thereby preventing air from being sucked into the pump chamber and enabling it to become filled with substance.

The invention also provides a receptacle fitted with a pump as defined above.

In an exemplary embodiment, the invention also provides independently or in combination with the above, a pump for mounting on a receptacle, the pump comprising:

a pump body; and a moving assembly that is movable relative to the pump body and that co-operates therewith to define a pump chamber of variable volume;

the pump having a moving assembly comprising a pushbutton and an insert fitted to the pushbutton, the pushbutton and the insert being arranged together to define a passage for delivering the substance when the pump is actuated to dispense the substance, and by the fact that the pushbutton comprises two portions, one of which is stationary relative to the insert and the other of which is movable relative thereto, the movable portion and the insert having respective surfaces suitable for co-operating to close the passage for delivering the substance when the moving assembly is in its rest position, and for disengaging the passage when the movable portion is moved through a determined distance relative to the stationary portion.

These and other features and advantages of the disclosed embodiments are described in, or are apparent from, the following detailed description of various exemplary embodiments according to this invention.

BRIEF DESCRIPTION OF THE DRAWINGS

The invention can be better understood on reading the following detailed description of non-limiting exemplary embodiments thereof, and on examining the accompanying figures, in which.

DETAILED DESCRIPTION OF PREFERRED EMBODIMENTS

Figure 1:
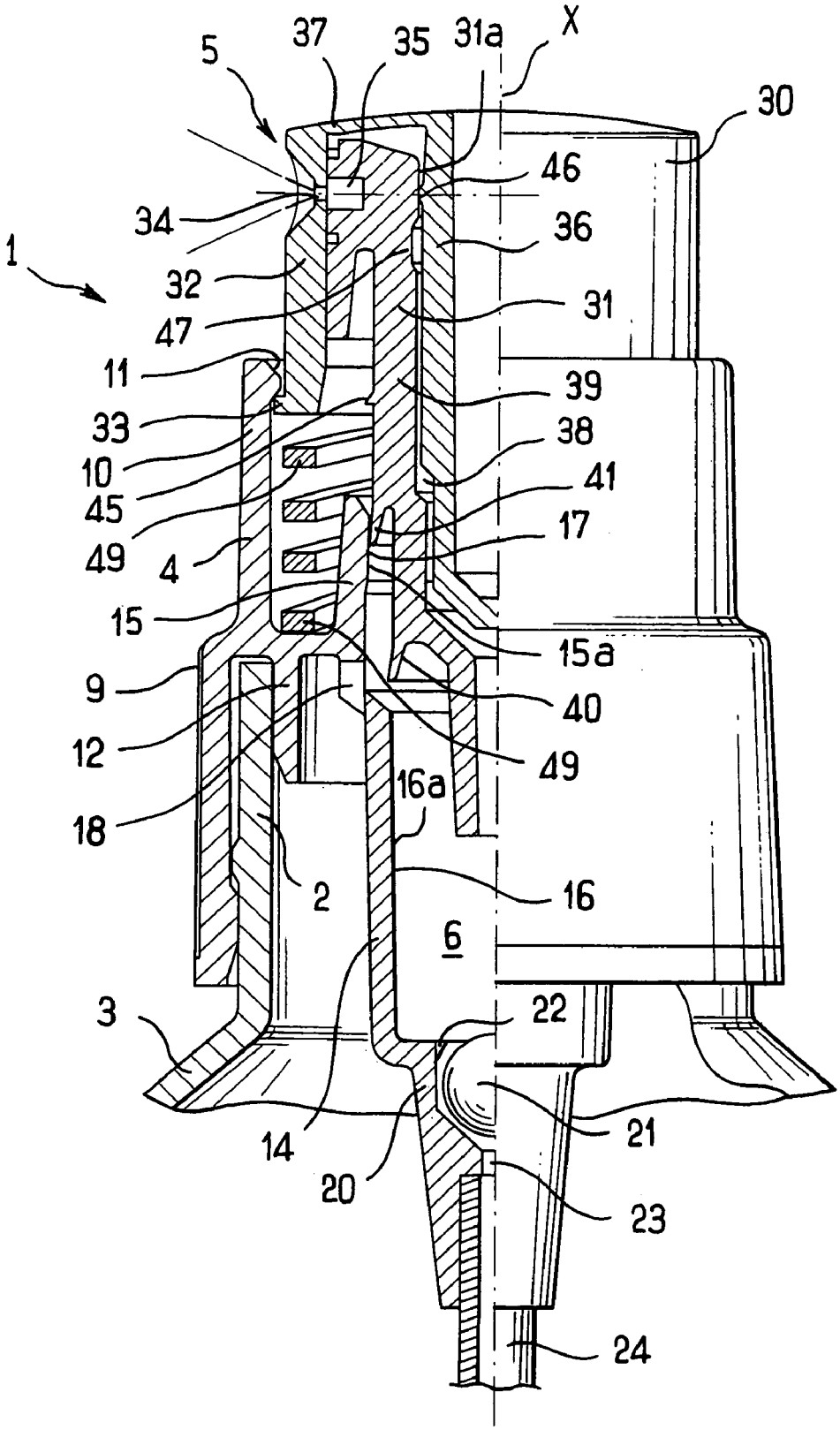
FIGS. 1–3 illustrate a first exemplary embodiment of a pump mounted on a receptacle according to this invention.

The following detailed description of various exemplary embodiments of a pump and a receptacle fitted therewith may refer to and/or illustrate one specific application, a spray bottle, for the sake of clarity and familiarity. However, it should be appreciated that the principles of this invention as outlined and/or discussed below can be equally applied to any known, or later-developed, pump and receptacle system beyond the simple spray bottle specifically discussed herein.

FIGS. 1–9 show a pump 1 mounted on a neck 2 of axis X of a receptacle 3 containing a substance P to be dispensed.

The pump 1 comprises a stationary portion 4 and a moving assembly 5 capable of moving along the axis X.

The stationary portion 4 includes an assembly skirt 9 secured to the neck 2 of the receptacle 3. In the exemplary embodiment described, the assembly skirt 9 is snap-fastened to the neck 2, but it should be appreciated that, in other embodiments, the assembly skirt could be fastened other ways such as, for example, by screw fastening or by crimping the assembly skirt 9.

The assembly skirt 9 is extended upwards by a cylindrical wall 10 having an inwardly-directed annular bead 11 at the top end of the cylindrical wall 10.

Figure 9:
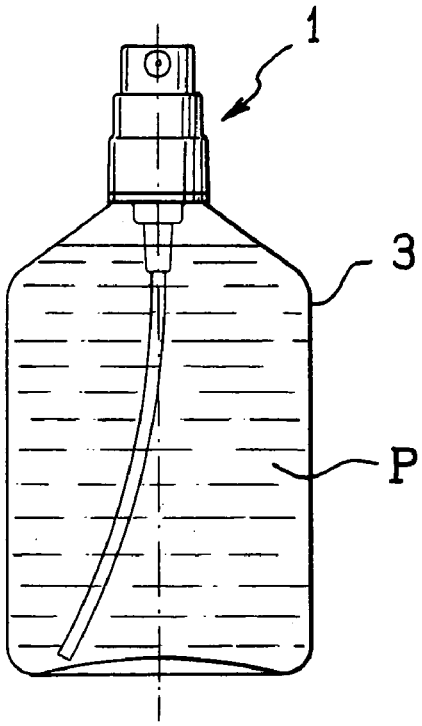
FIGS. 9–10 illustrate a first exemplary embodiment of a receptacle fitted with the pump according to this invention.
Figure 10:
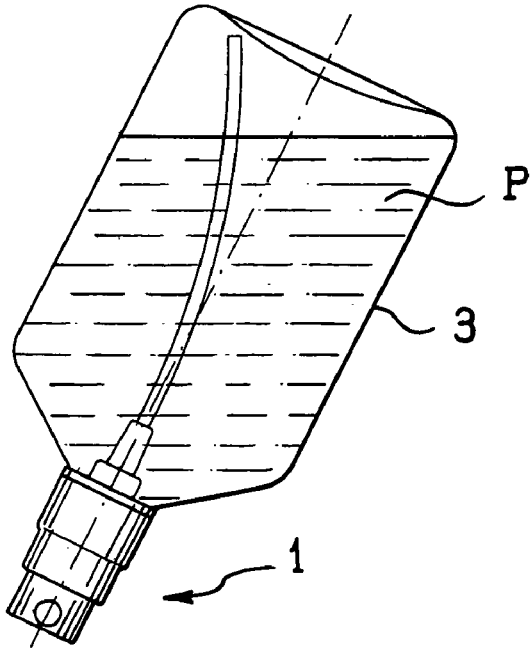

The stationary portion 4 also includes a sealing lip 12 bearing against the inside surface of the neck 2, and a pump body 14 co-operating with the moving assembly 5 to define a variable volume pump chamber 6. When the pump is observed head-up, as shown in FIG. 9, the pump body 14 presents an upper tubular wall 15 and a lower tubular wall 16 that are coaxial about the axis X.

The lower wall 16 presents a circularly cylindrical inside surface 16*a* of diameter smaller than the diameter of the likewise circularly cylindrical inside surface 15*a* defined by an annular bead 17 present at the top end of the upper wall 15.

The upper wall 15 is provided, at its base, with a plurality of side openings 18, only one of which is visible in the drawing. These openings 18 are distributed generally circumferentially around the upper wall 15. The pump body 14 need have only one of said openings.

The lower wall 16 is connected to an endpiece for fastening a dip tube 24 to the bottom end of the pump body 14. The endpiece 20 also defines a housing for a ball 21, which ball is held in its housing by bosses 22.

The housing for the ball 21 communicates via an orifice 23 with the dip tube 24.

The moving assembly 5 comprises a pushbutton 30 having an insert 31 fitted therein.

The pushbutton 30 comprises a first portion 32 which is stationary relative to the insert 31. The first portion 32 includes an outer tubular skirt presenting an annular bead 33 at its bottom end suitable for co-operating with the annular bead 11 of the cylindrical wall 10 in order to retain the moving assembly 5 on the portion 4 of the pump that is fastened to the receptacle 3.

The first portion 32 also includes a delivery orifice 34 communicating with a swirling channel chamber 35 formed in the insert 31 usable to enable the substance to be dispensed in the form of a spray.

The pushbutton 30 also includes a second portion 36 that is movable relative to the first portion 32. In the exemplary embodiment described, the second portion 36 comprises a hollow rod that is open at its top end and closed at its bottom end. This rod is connected to the first portion 32 by a web of material 37 that is elastically deformable and annular in shape.

The insert 31 has a central duct 39 in which the second portion 36 of the pushbutton 30 is engaged while leaving a passage 38 for delivery of the substance when the pump is actuated to dispense the substance.

Figure 2:
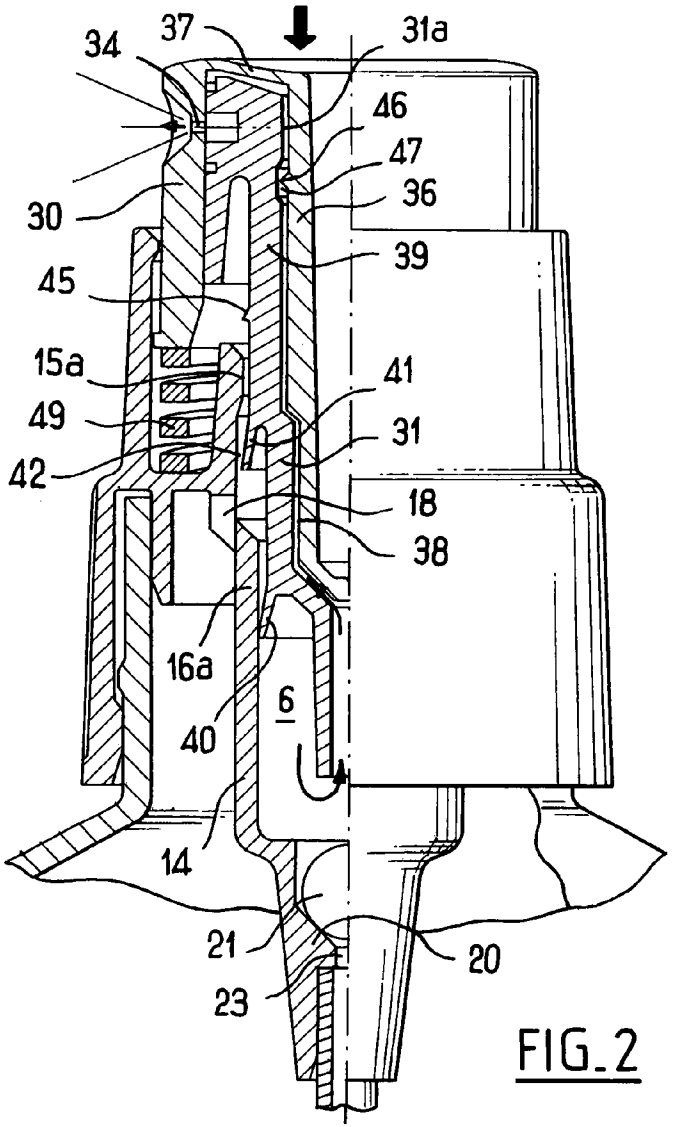
Figure 4:
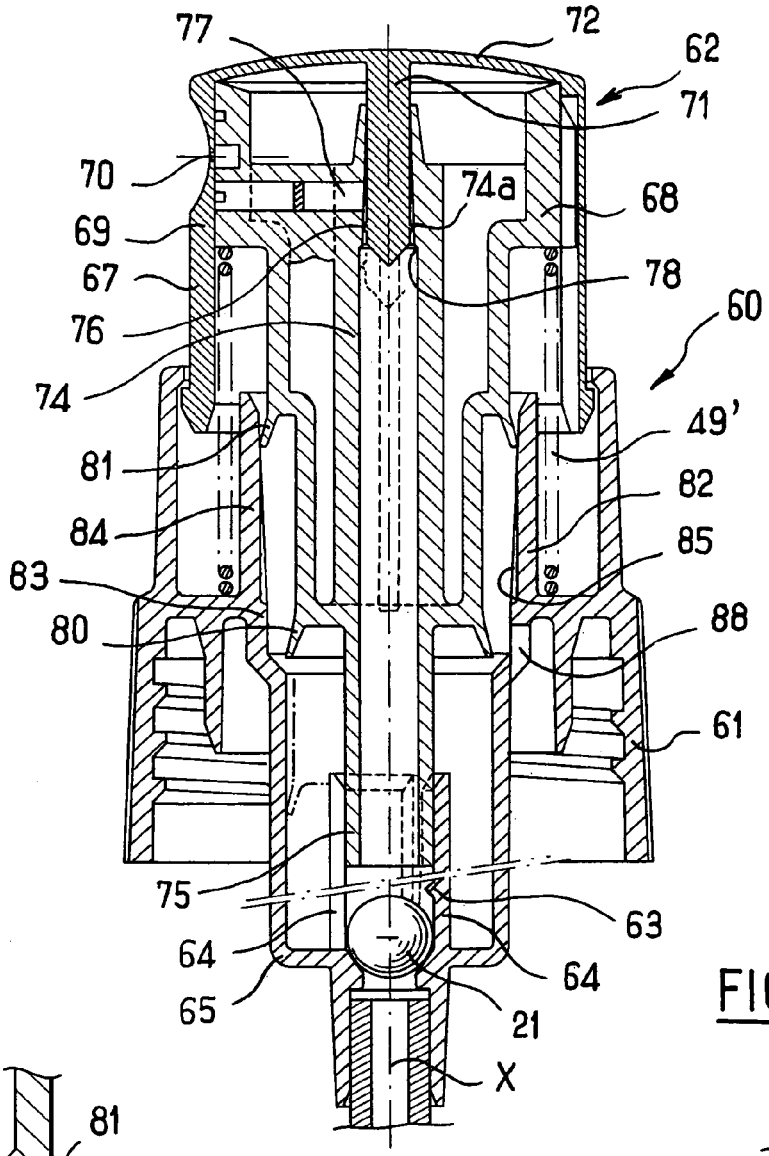
FIG. 4 illustrates a second exemplary embodiment of a pump according to this invention.

The insert 31 includes a first annular lip 40 arranged to press in leaktight manner against the inside surface 16*a* of the pump body 14 while the moving assembly 5 is being moved downward through a determined stroke from its rest position of FIG. 1, as shown in FIG. 2.

Above the first lip 40, the insert 41 has a second annular lip 41 bearing in leaktight manner against the inside surface 15*a* while the moving assembly is in its rest position, as shown in FIG. 1.

The shape of this second lip 41 is selected in such a manner that when it leaves the annular bead 17 during displacement of the moving assembly 5 to reduce the volume of the pump chamber 6, the lip 41 ceases to bear in leaktight manner against the upper wall 15 and co-operates therewith to leave an air intake passage 42 enabling the inside of the receptacle 3 to communicate with the outside through the plurality of openings 18, as shown in FIG. 2.

In the exemplary embodiment described, each of the lips 40 and 41 is frustoconical in shape, flaring toward the pump chamber 6.

Figure 3:
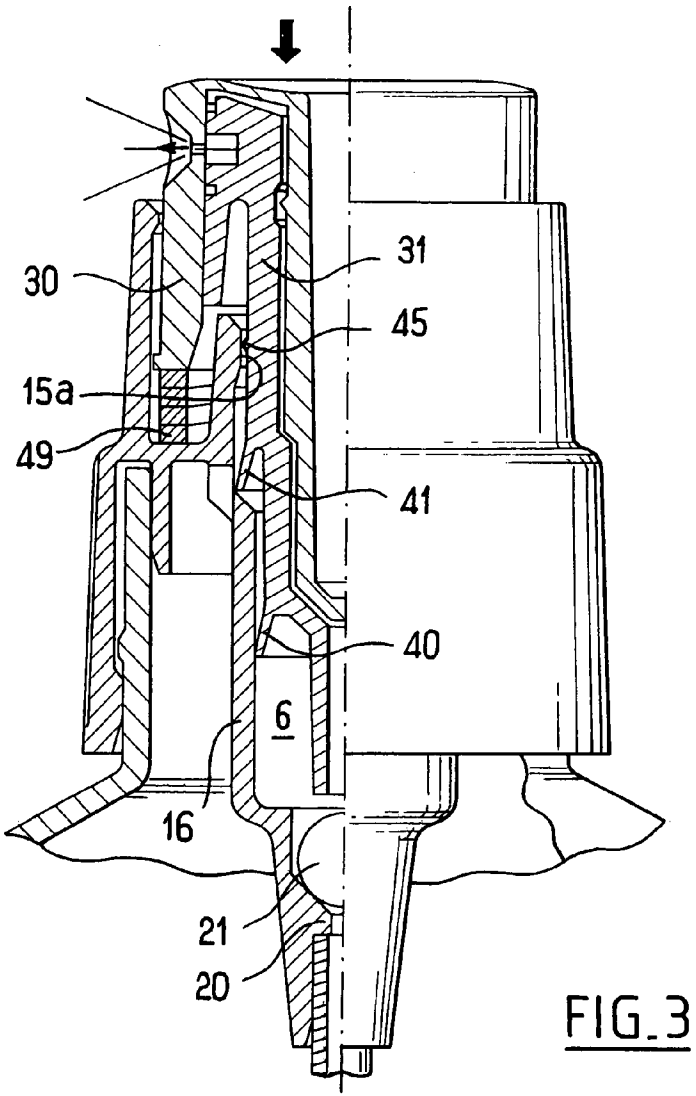

A third annular lip 45 is made on the insert 31 above the second lip 41 usable to bear in leaktight manner against the inside surface 15*a* when the moving assembly 5 is in its end-of-dispensing-stroke position, as shown in FIG. 3, closing the air intake passage 42.

The second portion 36 of the pushbutton 30 includes an annular lip 46 suitable for bearing in leaktight manner against the insert 31 to close the passage 38 for delivering substance while the moving assembly 5 is in its rest position.

A setback such as an annular groove is made in the insert 31. The lip 46 occupies a position facing this setback while the second portion 36 is moving downward through a certain distance relative to the insert 31, as shown in FIG. 2, thus allowing substance to pass from the pump chamber toward the outlet orifice 34.

The pushbutton 30 includes a helical spring 49 working in compression. In the exemplary embodiment described, the helical spring 49 is made integrally with the first portion 32, extending it downwards. The helical spring 49 is housed between the outer wall 10 and the inner wall 15 of the stationary portion 4.

An exemplary pump 1 according to this invention operates substantially as follows.

It is assumed initially that the pump 1 is being used head-up, and that it is initially in its rest position as shown in FIG. 1. It is assumed that the pump chamber 6 is full of substance following an earlier actuation cycle of the pump.

The inside of the receptacle is isolated from the outside by leaktight contact between the second lip 41 and the inside surface 15*a*, and by leaktight contact of the lip 46 of the pushbutton on the surface 31*a* of the insert 31 situated above the setback 47.

In order to dispense the substance, the user exerts downward pressure on the central, second portion 36 of the pushbutton 30.

Given that the rest shape of the web of material 37 is slightly outwardly convex, a certain amount of force is required to cause this web of material 37 to change configuration and deform, taking up a substantially upwardly concave configuration, as shown in FIG. 2.

In this way, the moving assembly 5 begins by moving relative to the stationary portion 4 of the exemplary pump 1 without the displacement of the second portion 36 relative to the first portion 32 being sufficient for the lip 46 to cease bearing in leaktight manner against the surface 31*a* of the insert 31.

In particular, in the exemplary embodiment described, the passage 38 for delivering substance remains closed by the lip 46 at least until the first lip 40 comes to bear in leaktight manner against the surface 16*a* of the pump body 14.

The pressure of the substance contained in the pump chamber 6 increases as the moving assembly continues to move, the ball 21 being pressed against its seat.

The force needed to move the moving assembly 5 relative to the stationary portion 4 increases as the substance is compressed in the pump chamber 6, and at some moment the force exerted on the pushbutton 30 becomes sufficient for the web of material 37 to deform to such an extent as to allow the lip 46 to reach the setback 47.

When a flow of substance can be established via the passage 38 between the pump chamber 6 and the outlet orifice 34, the substance is already compressed in the pump chamber 6, so the chamber 35 is fed with sufficient pressure to form a spray. Such an exemplary pump is termed a "precompression" pump.

Continued displacement of the moving assembly 5 relative to the stationary portion 4 of the pump 1 causes the volume of the pump chamber 6 to be decreased.

During downward displacement of the moving assembly 5, the second lip 41 ceases to press in leaktight manner against the surface 15*a*, such that the inside of the receptacle can communicate with the outside through the plurality of openings 18 and the passage 42, allowing air to be taken in, where appropriate.

At the end of the depression stroke of the moving assembly 5 relative to the stationary portion 4, the third lip 45 comes to bear against the surface 15*a*, thereby closing communication between the inside of the receptacle and the outside via the passage 42. During the displacement of the moving assembly 5, the helical spring 49 is compressed.

When the user ceases to press on the pushbutton 30, the web of material 37 tends to return to its initial configuration and the second portion 36 tends to move upward relative to the first portion 32, thereby reestablishing leaktight contact between the lip 46 and the insert 31, and closing the passage 38 that put the inside of the pump chamber 6 into communication with the delivery orifice 34.

Continued upward movement of the moving assembly 5 relative to the stationary portion 4 is accompanied by substance being sucked into the pump chamber 6 under the effect of the suction that is created therein, the first lip 40 pressing on the surface 16*a*. Air intake can occur via the passage 42 in order to compensate inside the receptacle for the volume of substance drawn in by the pump 1. While air is being taken in, the air that is sucked into the receptacle can oppose delivery of the substance via the passage 42 given the narrowness of the passage. Once the pump 1 returns to its rest position, the substance can remain inside the pump chamber 6 because the ball 21 tends, under the effect of its own weight, to be pressed against its seat and to close the orifice 23.

When the pump is used head-down, the pump chamber 6 can fill by the plurality of openings 18. Substance is dispensed in the same manner as in the head-up position. The same applies when the pump 1 is used in an intermediate position between its head-up and head-down positions, with the delivery orifice 34 pointing downward, providing the receptacle contains sufficient substance.

When the pump is used head-down, the fact that firstly the second lip 41 presses in leaktight manner against the surface 15*a* while the pump 1 is at rest and secondly that the lip 46 presses against the insert 31 in leaktight manner enables risk of substance leakage to be avoided.

The risk of substance leakage is also reduced, if the pump 1 is held head-down with the moving assembly 5 in its end-of-stroke position, because of the third lip 45 pressing against the surface 15*a*.

In the exemplary embodiment described, the pump chamber 6 presents a volume that is greater than the quantity or "dose" of substance that is dispensed, thereby making it possible to reduce the risk of the pump ceasing to be primed.

FIGS. 4–7 illustrate a pump 60 comprising a stationary portion 61 and a moving assembly 62 capable of moving along the axis X.

The stationary portion 61 is similar to the above-described stationary portion 4 with the exception that in this example the ball 21 is retained in its housing by bosses 63 made on tabs 64 extending from the bottom of the pump body 65, and the plurality of openings 18 are replaced by a single opening 88 situated on the side opposite from the delivery orifice 70.

The moving assembly 62 comprises a pushbutton 67 having an insert 68 fitted thereto.

The pushbutton 67 comprises a first portion 69 which is stationary relative to the insert 68 and which includes the delivery orifice 70, which orifice is similar to the above-described delivery orifice 34.

The pushbutton 67 further comprises a spike 71 which is movable axially relative to the first portion 69 and which is connected thereto by a web of material 72, like the second portion 36 of the pump 1.

The insert 68 includes a central duct 74 whose bottom end 75 penetrates into the space defined between the tabs 64.

The spike 71 is engaged in the top portion of the duct 74 and includes an annular bead 76 bearing in leaktight manner in the rest position against an annular region 74*a* of the wall of the duct 74 (shown in FIG. 4), thereby interrupting communication between the substance delivery passage 77 and the pump chamber.

The central duct 74 includes a portion of enlarged section 78 beneath the region 74*a*, which portion is arranged so that when the spike 71 is pushed into the duct 74 over a certain stroke, the annular bead 76 ceases to bear against the region 74*a*, thereby enabling substance to be delivered via the passage 77.

In the exemplary embodiment described, the fact that the opening 88 is situated on the side opposite to the delivery orifice 70, avoids the pump chamber emptying in the event of the pump being used substantially horizontal with the delivery orifice 70 pointing downward.

Unlike the insert 31 of the first exemplary embodiment above, the insert 68 has only two annular lips 80 and 81, analogous respectively to the annular lips 40 and 41 in FIG. 1. The insert 68 does not have a third annular lip.

The upper wall 82 of the pump body 65 comprises two annular regions 83 and 84 that are circularly symmetrical and that have at least one channel 85 extending along the axis X formed between them.

Figure 5:
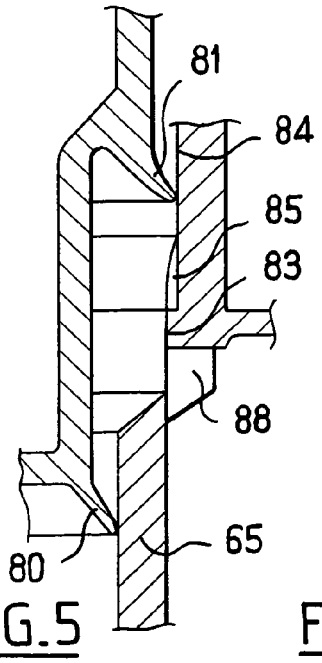
FIGS. 5–7 are cross-sectional views illustrating stages in the operation of the second exemplary embodiment of a pump according to this invention.
Figure 6:
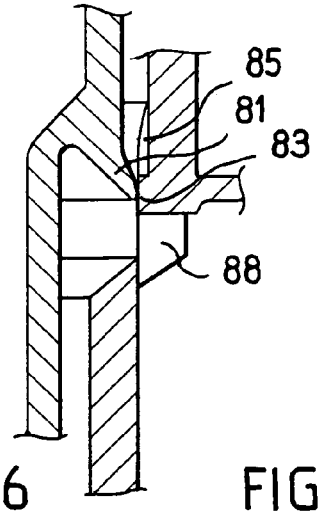
Figure 7:
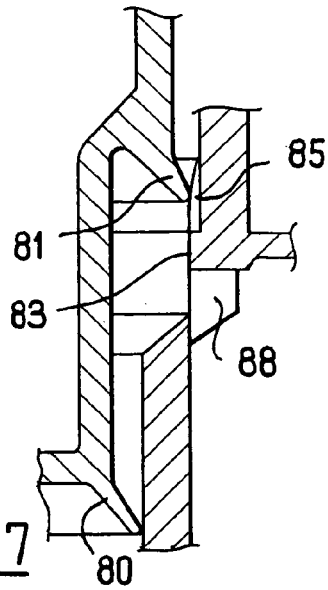

The second annular lip 81 can be pressed in leaktight manner against these regions 84 and 83, respectively, when the moving assembly 62 is occupying its rest position and its end-of-stroke position, as shown in FIGS. 5 and 6. The channel 85 can allow air to be taken in when the moving assembly 62 is occupying an intermediate position, as shown in FIG. 7.

Like pump 1, pump 60 is a precompression pump.

In order to dispense substance, the user exerts downward pressure on the pushbutton 67.

The moving assembly 62 begins by moving relative to the stationary portion 61 without the spike 71 moving relative to the first portion 69 sufficiently for the annular bead 76 to cease pressing in leaktight manner against the region 74*a* of the duct 74.

The passage 77 for delivering the substance thus remains isolated from the pump chamber by the bead 76, at least until the first lip 84 comes to bear in leaktight manner against the pump body 65, as shown in FIG. 5.

As described with reference to the pump 1, at a certain moment, the force exerted on the pushbutton 67 becomes sufficient for the web of material 72 to deform to a certain extent as to allow the annular bead 76 to go past the enlarged section 78, thereby allowing the substance to reach the passage 77.

During downward displacement of the moving assembly 62, as shown in FIG. 7, the second annular lip 81 ceases to press against the pump body 65, thereby making it possible for air to be taken in via the channel 85, should that be necessary.

At the end of the stroke of the moving assembly 62, the second annular lip 81 comes to press in leaktight manner against the region 83, as shown in FIG. 6, thereby preventing communication between the inside of the receptacle and the outside.

When the user ceases to press on the pushbutton 67, the web of material 72 tends to return to its initial configuration under the action of the spring 49'. The spike 71 moves upwards relative to the first portion 69 of the pushbutton 67 in such a manner that the annular bead 76 again presses against the region 74*a* of the duct 74. The passage 77 for delivering the substance is thus closed.

Continued upward movement of the moving assembly 62 relative to the stationary portion 61 causes substance to be sucked into the pump chamber, the first lip 80 pressing against the pump body 65 above the opening 88, as shown in FIG. 5.

Air may be taken in through the opening 88 while the second lip 81 is in an intermediate position between the regions 83 and 84, as shown in FIG. 7.

When the pump 60 is used head-down, the pump chamber can fill via the opening 88.

It is not essential in the exemplary embodiments according to this invention for the pushbutton 67 to have first and second portions that are movable relative to each other as is the case in the example described above.

Figure 8:
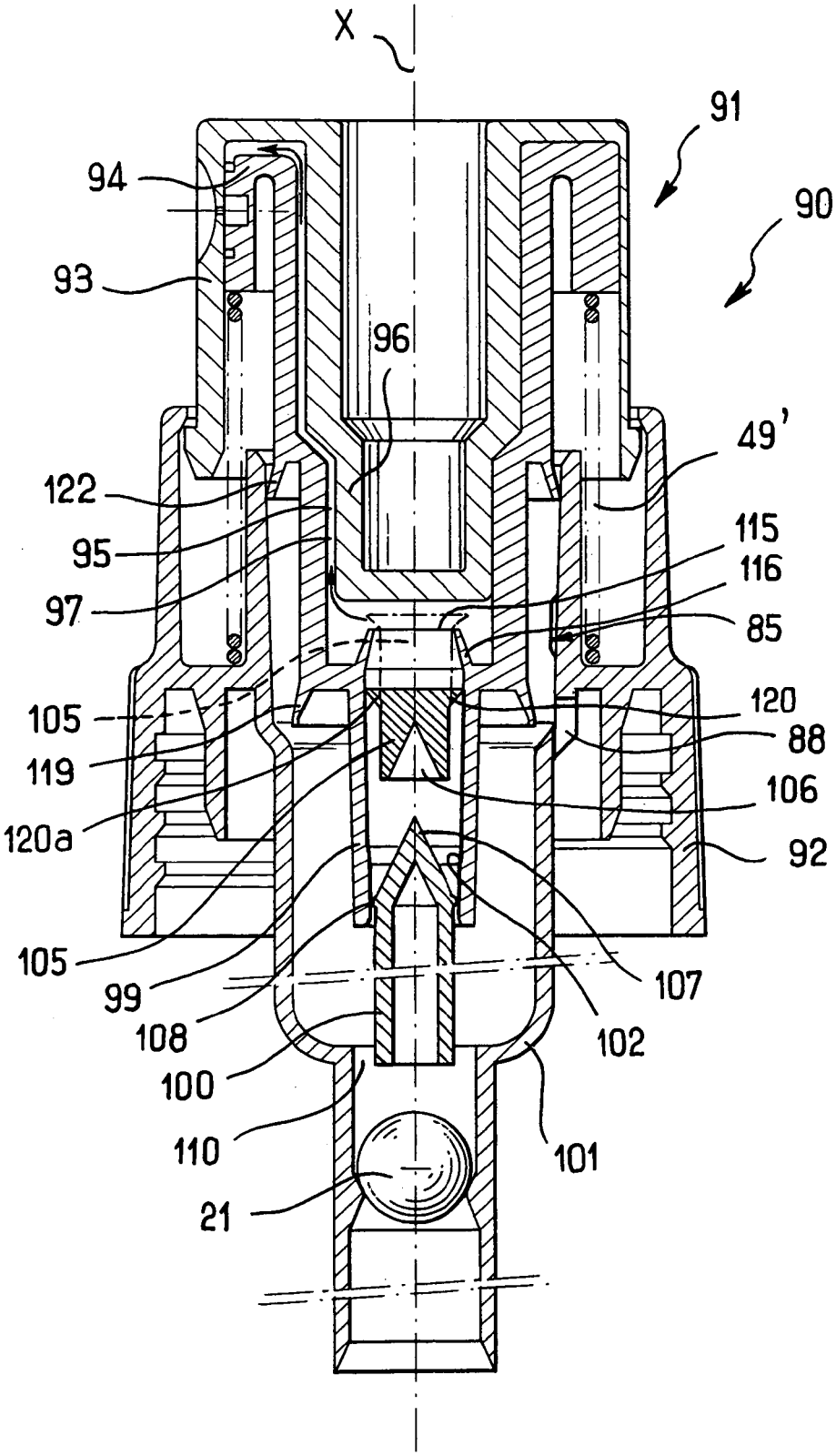
FIG. 8 illustrates a third exemplary embodiment of a pump according to this invention.

FIG. 8 illustrates a pump 90 comprising a moving assembly 91 capable of moving relative to a stationary portion 92.

The moving assembly 91 comprises a pushbutton 93 having an insert 94 fitted therein. The insert has two annular lips 119 and 122 similar respectively to the above-described lips 80 and 81.

The pushbutton 93 is stationary relative to the insert 94.

The insert 94 has a recess 95 extending substantially along the axis X and co-operating with a tubular central portion 96 of the pushbutton 93 to define a portion of the passage 97 for delivering the substance.

At its first portion, the insert 94 presents a cylindrical skirt 99 that is circularly symmetrical about the axis X and that is suitable for engaging on a central spike 100 of the pump body 101.

At its bottom end, the inside of the skirt 99 presents an annular bead 102, and at its top end it presents an opening 115 defined by a downwardly flaring frustoconical portion 116.

Prior to first use of the pump 90, the skirt 99 houses a valve member 105 disposed above the annular bead 102 and including at its top end a head 120 which can initially be secured to the skirt 99. The head 120 has a frustoconical annular surface 120*a*.

The skirt 99 and the valve member 105 may be made as a single piece by molding. The valve member 105 may be connected to the skirt 99 by a web of frangible material making it possible, after rupturing, to allow the valve member 105 to move relative to the skirt 99. The valve member 105 may also comprise an element made separately and then installed in the skirt 99 after the skirt has been manufactured.

The valve member 105 has a bottom conical recess 106 suitable for engaging on the conically-shaped top end 107 of the spike 100 when the moving assembly 91 has been depressed over a certain stroke.

At the base of the conical portion 107, the spike 100 has an annular bead 108. When the moving assembly 91 is in its rest position, the bead 108 bears against the annular bead 102 of the skirt 92 to prevent substance from penetrating into the skirt 99.

The spike 100 is connected to the remainder of the pump body 101 by bridges of material 110, e.g. being integrally molded with the remainder of the pump body.

Prior to first use of the pump 90, the user pushes in the moving assembly 91. After it has moved through a certain stroke relative to the stationary portion 92, the valve member 105 comes into abutment against the conical portion 107 of the spike 100. As the user continues to exert force on the moving assembly 91, the valve member 105 goes through the frustoconical portion 116 of the skirt 99 to take up the position shown in chain-dotted lines in FIG. 8, in which position the valve member 105 co-operates with the opening 115 to form a check valve.

The exemplary pump 90 operates substantially as follows.

It is assumed initially that the pump 90 is being used head-up, and is initially in its rest position as shown in FIG. 8.

It is assumed that the pump chamber is full of substance following an earlier actuation cycle of the pump.

The pump chamber is isolated from the outside by leaktight contact of the second lip 122 on the pump body 101 and by leaktight contact also of the annular bead 108 of the spike 100 on the annular bead 102 of the skirt 99.

To dispense the substance, the user exerts downward pressure on the moving assembly 91.

The exemplary pump 90 may be a precompression pump like the exemplary pumps 1 and 60, providing the height of the annular bead 102 is selected so that the beads 102 and 108 press against each other over a certain stroke of the moving assembly 91 relative to the stationary portion 92, at least until the annular lip 119 comes to press against the pump body 101 beneath the opening 88.

After a certain stroke has been traveled, the annular beads 102 and 108 cease to press against each other, thereby enabling the substance contained in the pump chamber to flow in the skirt 99 toward the delivery passage 97, with the pressure of the substance being suitable for lifting the valve member 105 so that the surface 120*a* of the head 120 ceases to press against the edge of the opening 115.

While the moving assembly 91 is moving inward relative to the stationary portion 92, the first and second annular lips 119 and 122 co-operate with the pump body 101 in a manner analogous to that described above for the annular lips 80 and 81.

When the user ceases the press on the pushbutton 93, the moving assembly 91 tends to return to its initial position under drive from the spring 49'.

The head 120 of the valve member 105 then returns to press against the edge of the opening 115 of the skirt 99 to isolate the pump chamber from the outside and to enable substance to be sucked into pump chamber under the effect of the suction which is created therein, the first lip 119 being pressed against the pump body 101 beneath the opening 88.

The invention is naturally not limited to the embodiments described above.

The ball 21 may be replaced in particular by any other suitable check valve, in particular an elastomer check valve fitted to, or overmolded on, the pump body.

It would not go beyond the ambit of the present invention for the pump to operate without precompression, using a moving assembly configured differently.

Throughout the description, including in the claims, the term "comprising a" should be considered as synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative exemplary embodiments. Other arrangements, alternatives, modifications, variations and/or improvements may be devised without departing from the spirit and scope of the present invention. Therefore, the structures and/or devices according to this invention are intended to embrace all known, or later developed alternatives, modifications, variations, and/or improvements.

What is claimed is:

1. A pump for mounting on a receptacle, comprising:

a pump body having at least one opening;

a moving assembly movable relative to the pump body and co-operating therewith to form a pump chamber of variable volume, the at least one opening allowing the pump chamber to communicate with an inside of the receptacle and allowing the pump to operate in a head-down position;

an air intake passage formed between the pump body and the moving assembly and capable of communicating with the opening of the pump body;

a first lip configured, after the moving assembly has moved away from a rest position in a substance-dispensing direction, to press in leaktight manner against the pump body and prevent communication between the inside of the receptacle and the pump chamber via the opening; and a second lip situated above the first lip when the pump is observed in a head-up position, said second lip being configured to close the air intake passage when the moving assembly is in the rest position and to release the air intake passage when the moving assembly is displaced in the substance-dispensing direction, wherein the moving assembly comprises at least one lip selected among the second lip or a third lip and configured to press against the pump body to close the air intake passage when the moving assembly is substantially at the end of a substance-dispensing stroke.

2. A pump according to claim 1, wherein each of the first and second lips is substantially frustoconical in shape, flaring toward the pump chamber.

3. A pump according to claim 1, wherein the at least one lip is the third lip.

4. A pump according to claim 1, wherein the at least one lip is the second lip.

5. A pump according to claim 4, wherein the pump body further comprises a setback situated between two regions against which the second lip presses while the moving assembly is in at least one of a rest position or an end-of-stroke position, said setback providing communication between said regions while the moving assembly is in an intermediate position between a rest position or an end-of-stroke position.

6. A pump according to claim 1, wherein the moving assembly comprises a pushbutton and an insert fitted to the pushbutton, the pushbutton and the insert configured together to form a passage for delivering a substance contained in the receptacle, at least while the pump is actuated to dispense the substance.

7. A pump according to claim 6, wherein the at least one lip is the third lip.

8. A pump according to claim 7, wherein the first, second, and third lips are made on the insert.

9. A pump according to claim 6, wherein the pushbutton comprises a stationary portion which is stationary relative to the insert, and a movable portion which is movable relative to the insert.

10. A pump according to claim 9, wherein the insert and the movable portion comprise respective surfaces suitable for co-operating to close the passage for delivering the substance while the moving assembly is in the rest position.

11. A pump according to claim 9, wherein the insert and the moveable portion comprise respective surfaces suitable for opening the passage for delivering the substance once the moveable portion has moved through a determined distance relative to the stationary portion.

12. A pump according to claim 11, wherein the pushbutton is configured so that the movable portion can move relative to the insert through said determined distance from the rest position only once the force exerted on the pushbutton exceeds a threshold.

13. A pump according to claim 9, wherein the stationary portion and the movable portion of the pushbutton are interconnected by a web of elastically-deformable material.

14. A pump according to claim 13, wherein the web of material is annular in shape.

15. A pump according to claim 1, further comprising a resilient return element configured for returning the moving assembly into the rest position.

16. A pump according to claim 15, wherein the resilient return element is disposed outside the pump chamber.

17. A pump according to claim 15, wherein the resilient return element comprises a helical spring working in compression.

18. A pump according to claim 15, wherein the resilient return element is made integrally with the pushbutton.

19. A pump according to claim 1, wherein the pump body is configured to receive a dip tube.

20. A pump according to claim 19, further comprising a check valve that closes while the volume of the pump chamber is decreasing and that opens while the volume of the pump chamber is increasing, said check valve usable to allow the pump chamber to be fed with substance via the dip tube.

21. A pump according to claim 1, wherein the moving assembly further comprises a delivery orifice situated on a side opposite from the opening about the axis of the pump.

22. A pump according to claim 1, wherein a volume of the pump chamber in the rest position is greater than a volume of a quantity of substance to be dispensed during a stroke.

23. A pump according to claim 6, further comprising a resilient return element usable to return the moving assembly to the rest position.

24. A pump according to claim 6, wherein the pushbutton is stationary relative to the insert.

25. A pump according to claim 24, wherein the insert comprises a skirt configured for co-operating in leaktight manner with a spike of the pump body when the pump is at rest, isolating the pump chamber from the outside.

26. A pump according to claim 25, wherein the insert comprises a valve member usable for closing a top opening of the skirt while the volume of the pump chamber is increasing and for enabling substance to flow through a top opening of the skirt while the volume of the pump chamber is decreasing.

27. A pump according to claim 26, wherein, the valve member is housed entirely inside the skirt before first use of the pump.

28. A pump according to claim 27, wherein the valve member comprises a conical recess configured for co-operating with a conical portion of the spike.

29. A receptacle fitted with a pump according to claim 1.

30. A pump for mounting on a receptacle, comprising:

a pump body having at least one opening;

a moving assembly movable relative to the pump body and co-operating therewith to form only a single pump chamber of variable volume, the at least one opening allowing the pump chamber to communicate with an inside of the receptacle and allowing the pump to operate in a head-down position;

an air intake passage formed between the pump body and the moving assembly and capable of communicating with the opening of the pump body;

a first lip configured, after the moving assembly has moved away from a rest position in a substance-dispensing direction, to press in leaktight manner against the pump body and prevent communication between the inside of the receptacle and pump chamber via the opening; and a second lip situated above the first lip when the pump is observed in a head-up position, said second lip being configured to close the air intake passage when the moving assembly is in the rest position and to release the air intake passage when the moving assembly is displaced in the substance-dispensing direction.

31. A pump for mounting on a receptacle, the pump comprising:

a dispenser orifice;

a pump body; and a moving body that is movable relative to the pump body and that co-operates therewith to define a pump chamber of variable volume;

wherein the moving body comprises a pushbutton and an insert fitted to the pushbutton, the pushbutton and the insert being arranged together to define a passage for delivering the substance when the pump is activated to dispense the substance, the pushbutton comprising two portions, one of which defines the dispenser orifice and is stationary relative to the insert and the other of which is movable relative thereto, the moveable portion and the insert having respective surfaces suitable for co-operating to close the passage for delivering the substance when the moving assembly is in its rest position, and for disengaging the passage when the movable portion is moved through a determined distance relative to the stationary portion.

* * * * *